US008739373B1

(12) United States Patent
Berman

(10) Patent No.: US 8,739,373 B1
(45) Date of Patent: Jun. 3, 2014

(54) SHOELACE CLASP

(71) Applicant: Barry J. Berman, Jacksonville, OR (US)

(72) Inventor: Barry J. Berman, Jacksonville, OR (US)

( * ) Notice: Subject to any disclaimer, the term of this patent is extended or adjusted under 35 U.S.C. 154(b) by 0 days.

(21) Appl. No.: 13/868,982

(22) Filed: Apr. 23, 2013

(51) Int. Cl.
*A43C 7/04* (2006.01)

(52) U.S. Cl.
USPC ..... 24/712.6; 24/712.7

(58) Field of Classification Search
None
See application file for complete search history.

(56) References Cited

U.S. PATENT DOCUMENTS

| | | | | | |
|---|---|---|---|---|---|
| 56,806 | A | | 7/1866 | Scripture | |
| 105,236 | A | | 7/1870 | O'Hara | |
| 528,464 | A | * | 10/1894 | Craig | 24/712.2 |
| 537,934 | A | * | 4/1895 | Patton | 24/712.6 |
| 574,484 | A | * | 1/1897 | Johnson | 24/712.2 |
| 670,561 | A | * | 3/1901 | Hoegemann | 24/712.6 |
| 797,705 | A | * | 8/1905 | Parker | 24/712.6 |
| 1,104,259 | A | * | 7/1914 | Gwirtz | 24/712.2 |
| 1,146,934 | A | * | 7/1915 | Gleeson | 132/273 |
| 1,190,724 | A | * | 7/1916 | Chadwick | 24/712.7 |
| 1,305,884 | A | * | 6/1919 | Chromy | 24/132 R |
| 1,413,690 | A | * | 4/1922 | Slocum | 188/65.4 |
| 1,551,829 | A | * | 9/1925 | Maxwell | 24/299 |
| 1,616,694 | A | | 2/1927 | Hoppe | |
| 1,834,401 | A | | 5/1927 | Hoppe et al. | |
| 1,653,235 | A | * | 12/1927 | Sorell | 24/30.5 R |
| 1,730,462 | A | | 10/1929 | Jaques | |
| 1,801,051 | A | * | 4/1931 | Malsbury et al. | 24/712.5 |
| 1,871,064 | A | * | 8/1932 | Kipper et al. | 40/662 |
| 2,113,731 | A | * | 4/1938 | Kennedy | 24/713.2 |
| 2,164,123 | A | * | 6/1939 | Rio | 24/712.5 |
| 2,254,579 | A | | 9/1941 | Okie | |
| 3,108,343 | A | | 10/1963 | Mo et al. | |
| 3,290,745 | A | | 12/1966 | Maxwell et al. | |
| 3,296,669 | A | * | 1/1967 | Elder, Jr. | 24/712.6 |
| 3,418,733 | A | * | 12/1968 | Tyrrell, Sr. et al. | 36/50.1 |
| 3,822,445 | A | | 7/1974 | Feng | |
| 4,008,512 | A | * | 2/1977 | Prodel | 24/16 PB |
| 4,143,446 | A | * | 3/1979 | Down | 24/115 R |
| 4,236,281 | A | * | 12/1980 | Bottum | 24/115 R |
| 4,715,094 | A | * | 12/1987 | Herdman | 24/712.3 |
| 4,790,048 | A | * | 12/1988 | Arnt | 24/712.1 |
| 4,854,138 | A | * | 8/1989 | Charland | 70/16 |
| 4,908,911 | A | * | 3/1990 | Bretti et al. | 24/16 PB |
| 5,001,847 | A | | 3/1991 | Waters | |
| 5,022,127 | A | * | 6/1991 | Ang | 24/712.2 |
| 5,088,158 | A | * | 2/1992 | Burkholder | 24/16 PB |
| 5,136,756 | A | * | 8/1992 | Krauss | 24/265 H |
| 5,304,188 | A | * | 4/1994 | Marogil | 606/157 |
| 5,537,719 | A | * | 7/1996 | Freed | 24/16 PB |
| 5,566,427 | A | * | 10/1996 | Lathrop | 24/169 |
| 5,572,778 | A | * | 11/1996 | Stenner et al. | 24/712.9 |
| 5,651,376 | A | * | 7/1997 | Thompson | 128/878 |
| 5,718,021 | A | * | 2/1998 | Tatum | 24/712.2 |
| 5,802,888 | A | * | 9/1998 | Parsons | 70/16 |
| 5,903,959 | A | * | 5/1999 | Leonardi | 24/712.1 |
| 5,979,095 | A | * | 11/1999 | Schneider et al. | 40/633 |

(Continued)

*Primary Examiner* — Jack W. Lavinder
(74) *Attorney, Agent, or Firm* — Palomar Patent; Calif Tervo

(57) ABSTRACT

A clasp for clasping the end sections of a shoelace for tightening a shoe is configurable between an open position for receiving the end sections and a closed position clasping the end sections. The clasp is connected to a shoe and generally includes a base and a cover hingedly connected to the base. The base includes two elongate channels for receiving the shoelace ends. The cover closes over the base and the received laces. The cover and base include cooperating ratchet teeth that allow the laces to be tightened but not loosened without opening the cover.

6 Claims, 2 Drawing Sheets

(56) References Cited

U.S. PATENT DOCUMENTS

| | | | | |
|---|---|---|---|---|
| 6,119,314 | A * | 9/2000 | Freed | 24/16 PB |
| 6,192,559 | B1 | 2/2001 | Munsell, Jr. | |
| 6,247,214 | B1 | 6/2001 | Hyde | |
| 6,539,589 | B2 * | 4/2003 | Thompson | 24/16 PB |
| 6,718,602 | B1 * | 4/2004 | Chang | 24/712.1 |
| 7,152,285 | B2 | 12/2006 | Lino | |
| 7,152,286 | B2 | 12/2006 | Rooney et al. | |
| D626,322 | S | 11/2010 | Servettaz | |
| 7,946,007 | B2 | 5/2011 | Borsoi | |
| D664,348 | S | 7/2012 | Armstrong | |
| 8,371,004 | B2 * | 2/2013 | Huber et al. | 24/712.2 |
| 2004/0172850 | A1 * | 9/2004 | King, Jr. | 36/50.1 |
| 2008/0250618 | A1 * | 10/2008 | Stramare et al. | 24/712.7 |
| 2010/0236033 | A1 * | 9/2010 | Liu | 24/712.5 |

* cited by examiner

FIG 1
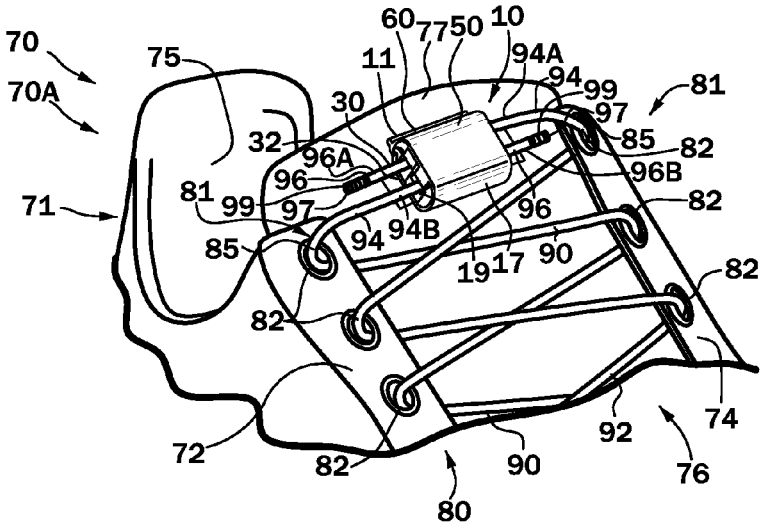
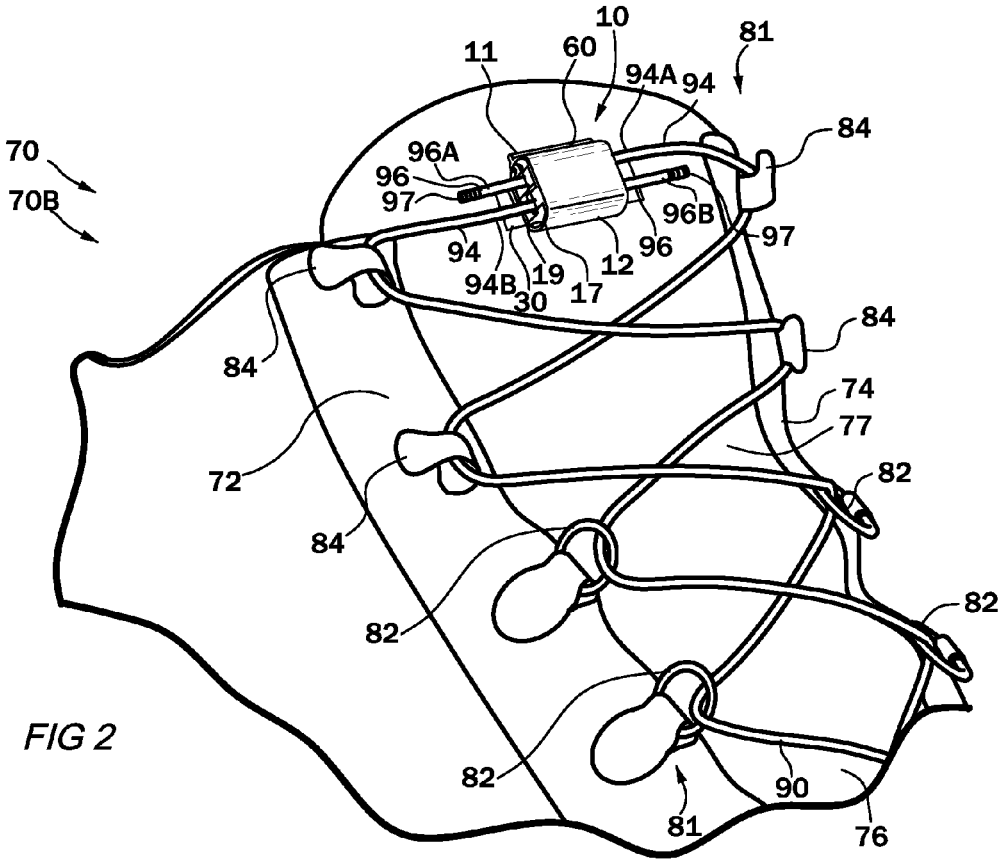
FIG 2

FIG 3
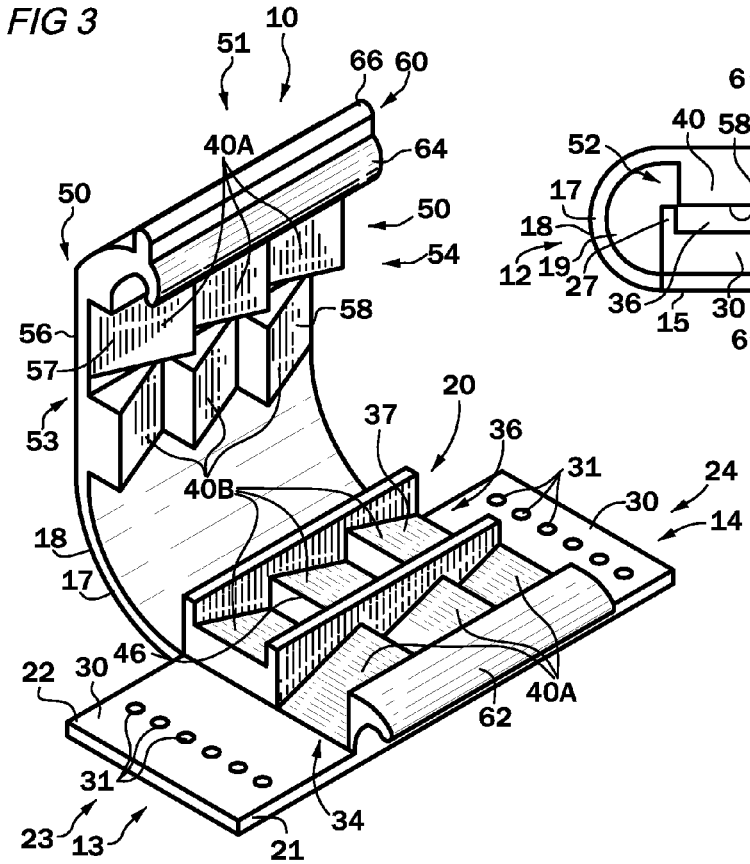
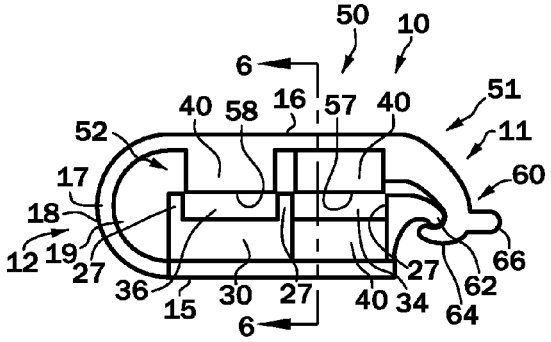
FIG 5
FIG 4
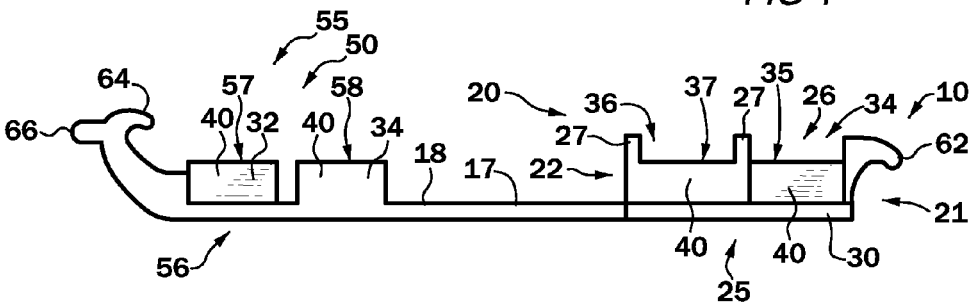
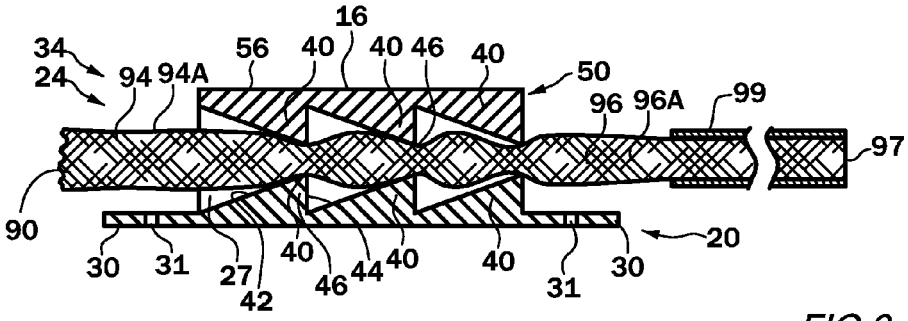
FIG 6

SHOELACE CLASP

FIELD OF THE INVENTION

This invention relates in general to a clasp for clasping the ends of a shoelace to keep the lace in tension and that allows the laces to be easily tightened.

BACKGROUND OF THE INVENTION

It is well known that shoelaces require tying and untying the two ends thereof at every use. Many times the laces come undone prematurely which, of course, is not desired. Knots and bows are subject to problems caused by ice, mud, and snags on debris or bushes.

Also, tying of shoelaces is difficult or impossible for some wearers. For example, parents may be required to spend time and exertion tying young children's laces. Once tied, children may play with the knot, step on a lace end, or otherwise cause the laces to work free through normal walking. For children and adults, laces which come undone prematurely represent at best more work to retie and at worst an opportunity for a tripping accident.

Also, persons with problems with manual dexterity, such as arthritis sufferers, may find tying shoelaces to be difficult if not impossible.

There might be disastrous results if a loose shoelace became entangled in a bicycle chain.

A variety of devices has been developed for locking shoelaces without requiring the tying thereof. For the most part, these devices are overly complicated such that they are not practical.

Another problem with previous shoelace locks is that those that are not integral with the shoe may easily come entirely separated from the shoe when not in use.

Another shortcoming of some prior art devices is the laces cannot be retightened without once again going through the entire clamping procedure.

Therefore it is desirable to have an improved shoelace fastening device that users can operate with much less effort, dexterity and time than is necessary for tying laces and which eliminates the possibility of premature unfastening.

It is further desirable that the device is easily attachable to a shoe without detracting from its utility, ease of use, and appearance.

It further desirable that the shoelace fastening device provide for fast and easy re-tightening of a shoelace.

SUMMARY OF THE INVENTION

This invention is a clasp for clasping the end sections of a shoelace for tightening a shoe. The clasp is configurable between an open position for receiving the end sections and a closed position clasping the end sections. The clasp is connected to a shoe and generally includes a base and a cover hingedly connected to the base. The base includes two elongate channels for receiving the shoelace end sections. The cover closes over the base and the received laces. The cover and base include cooperating ratchet teeth that allow the laces to be tightened but not loosened while the cover is closed.

According to one aspect of the invention, the hinge is a flexible band that forms an arc in the closed position such that a tunnel is created between the hinge and the base and cover. The loose ends of the shoelace may be placed in the tunnel.

According to another aspect of the invention, the last lacing anchors, usually the uppermost anchors, are lacing hooks instead of eyelets.

The clasp of the invention is applicable to a wide variety of footwear including casual, athletic and bicycle shoes and work, hiking, and military boots.

The features and advantages of the invention will be readily understood when the detailed description thereof is read in conjunction with the drawings wherein like reference numerals refer to like parts throughout.

BRIEF DESCRIPTION OF THE DRAWINGS

FIG. 1 is a perspective view of an illustrative embodiment of the shoelace clasp of the invention attached to a shoe and clasping the shoelace; the shoe being partially cut away.

FIG. 2 is a perspective view of an illustrative embodiment of the shoelace clasp of the invention attached to a boot and clasping the shoelace; the boot being partially cut away.

FIG. 3 is an enlarged left, front, top, perspective view of the clasp of FIG. 1 in an open position.

FIG. 4 is a left side elevation view of the clasp in an open position.

FIG. 5 is a left side elevation view of the clasp in the closed position.

FIG. 6 is a sectional view taken on line 6-6 of FIG. 5 further including a shoelace.

DETAILED DESCRIPTION OF THE INVENTION

With reference now to the drawings, there is shown in FIG. 1 a perspective view of an illustrative embodiment of the shoelace clasp 10 of the invention in use attached to footwear 70, such as shoe 70A, shown partially cut away, and clasping a shoelace 90.

Shoe 70A includes a lower, not shown, an upper 71 including, in the rear, a foot-receiving opening 75 and, in the front, a first facing 72 and a second facing 74 separated by a gap or throat 76. Throat 76 is spanned behind by a tongue 77. Shoe 70A has a lacing system 80 whereby shoelace 90 adjusts the width of throat 76 to secure shoe 70A on a user's foot.

In the illustrative embodiment, lacing system 80 includes lacing anchors 81, such as lace turning anchors, such as eyelets 82 on first facing 72 and on second facing 74 on opposite sides of throat 76, for lacing shoelace 90 or otherwise securing shoelace 90 to shoe 70A. The upper most pair of lacing anchors 81 is typically the last lacing anchors 85, that is, the last anchors 81 before shoelace 90 enters clasp 10. Shoelace 90 includes free ends 97, a midsection 92, and end sections 94 after the last lacing anchors 85 before clasp 10. An aglet 99 is typically attached to end section 94 adjacent each free end 97. Shoelace 90 is laced through eyelets 82 in a desired manner. Although specific lacing anchors 81 are shown for illustrative purposes, clasp 10 is operable with most lacing systems 80, whatever lacing anchors 81 are used.

Clasp 10 is attached to shoe 70A, such as to tongue 77. Clasp 10 has open and closed positions. Clasp 10 is shown in FIG. 1 in a closed position clasping end sections 94 near free ends 97. End section 94 includes a loose section 96 on the same side of clasp 10 as the respective free end 97.

FIG. 2 is a perspective view of an illustrative embodiment of the shoelace clasp 10 of the invention attached to footwear 70, such as a boot 70B, having a long throat 76 that is laced. Boot 70B is shown partially cut away with only the uppermost shown. Clasp 10 clasps shoelace 90.

Boot 70B is similar to shoe 70A except upper 71 extends above a user's ankle and includes additional lacing anchors 81, such as lacing hooks 84. The uppermost or last anchors 85 are hooks 84. Typically, boot 70B has eyelets 82 over throat 76 over the user's foot and hooks 84 over throat 76 over the ankle and shin. Shoelace 90 is laced through eyelets 82 and around hooks 84 in a desired manner.

Further including FIGS. 3-6, FIG. 3 is an enlarged left, front, top, perspective view of clasp 10 of FIGS. 1 and 2 in an open position; FIG. 4 is a left side elevation view of clasp 10 in an open position; FIG. 5 is a left side elevation view of clasp 10 in a closed position; and FIG. 6 is a sectional view taken on line 6-6 of FIG. 5, further showing a clasped shoelace end section 94.

Clasp 10, in the closed position shown in FIGS. 1, 2, and 5, has a front side 11, a rear side 12, a left side 13, a tight side 14, a bottom 15, and a top 16. Clasp 10 generally includes a base 20 and a cover 50 hingedly attached to base 20, such as with a living or flexible hinge 17. Clasp 10 includes attachment means, such as left and right flanges 30 on base 20, for fastening clasp 10 to footwear 70. Flanges 30 include means, such as bores 31, to secure base 20 to footwear 70, such as to tongue 77 by use of fasteners such as thread or rivets. Any of many other appropriate fastening means, such as prongs or glue could also be used.

Preferably, clasp 10 is attached to footwear 70, such as shoe 70A or boot 70B, such as to tongue 77 such that rear side 12 including hinge 17 is disposed downward or toward the toe of footwear 70 such that front side 11 of clasp 10 including a catch 60 is disposed upward such that clasp 10 opens facing the user. Clasp 10 is shown in FIGS. 1 and 2 in a closed position clasping end sections 94 near free ends 97. End section 94 includes a loose section 96 on the same side of clasp 10 as the respective free end 97.

Base 20 has a front side 21, a rear side 22, a left side 23, a right side 24, a bottom 25, and a top 26. Base 20 includes a plurality of walls 27 defining a side-to-side, upward-opening, first channel 34 having a longitudinal axis and a side-to-side, upward opening second channel 36 having a longitudinal axis. First channel 34 has an upward facing surface 35. Second channel 36 has an upward facing surface 37.

Each shoelace end section 94 has an unsecured portion or loose portion 96 adjacent each free end 97. As best seen in FIG. 6, first channel 34 longitudinally receives a first end section 94A, such that lace 90 protrudes from both ends of first channel 34. Similarly, as seen in FIGS. 1 and 2, second channel 36 longitudinally receives a second end section 94B, such that lace 90 protrudes from both ends of second channel 36

Cover 50 has a front side 51, a rear side 52, a left side 53, a right side 54, a bottom 55, and a top 56. Cover 50 includes a downward facing first surface 57 and a downward facing second surface 58. Cover 50 is selectively movable from open positions shown in FIG. 3 or 4 to a closed position shown in FIGS. 1, 2, 5 and 6. In the open position, lace end sections 94 may be freely placed in or removed from channels 34, 36 by the user. With cover 50 in the closed position as shown in FIGS. 1, 2. 5, and 6, first surface 57 of cover 50 overlies surface 35 of first channel 34 and second surface 58 of cover 50 overlies surface 37 of second channel 36.

In the exemplary embodiment, first surface 57 of cover 50 and surface 35 of first channel 34 include a plurality of ratchet teeth 40, such as first ratchet teeth 40A, and second surface 58 of cover 50 and surface 37 of second channel 36 include a plurality of second ratchet teeth 40B, such that, in the closed position, first ratchet teeth 40A engage lace first end section 94A in first channel 34 such that the lace first end section 94A may be moved longitudinally to the right by pulling first loose section 96A so as to tighten lace 90 but may not be moved to the left. Second surface 58 of cover 50 and surface 37 of second channel 36 include a plurality of second ratchet teeth 40B; such that, in the closed position, second ratchet teeth 40B engage the lace second end section 94B in second channel 36 such that lace second end section 94B may be moved longitudinally to the left by pulling second loose section 96B so as to tighten lace 90 but may not be moved to the right.

Each first ratchet tooth 40A has a left-facing, gently-sloped face 42 and a right-facing, steeply-sloped face 44 meeting at a dihedral angle 46. Gently sloped face 42 is angled at 45° or less. Steeply sloped face 44 is greater than 75° and is preferably about 90° or more, such that dihedral angle 46 is 45° or less.

Clasp 10 includes retaining means 60 for selectively retaining clasp 10 in the closed position such that shoelace end sections 94 are gripped. In the exemplary embodiment, base 20 and cover 50 include interacting catch means 61 for selectively holding clasp 10 in the closed position. Front side 21 of base 20 includes a catch member, such as lip 62, that interacts with a catch member, such as resilient hook 64, on front side 51 of cover 50 to retain clasp 10 in the closed position. Means for aiding in the release of hook 64 from lip 62 includes a protuberance or release ridge 66 on hook 64. A user uses thumbs and finger to push release ridge 66 away from tongue 77 to disengage hook 64 from lip 62 and open clasp 10.

As best seen in FIGS. 3-5, hinge 17 may be a flexible band 18 that forms an arc in the closed position such that a tunnel 19 is created between hinge 17 and base 20 and said cover 50. Shoelace loose sections 96 may be inserted into tunnel 19 for storage, although the clasp will function perfectly fine with short shoelace ends just, about one inch, past the sides of the clasp making storage unnecessary as shown in the drawings.

From the foregoing description, it is seen that the present invention provides an extremely simple, efficient, and reliable device for securing the end sections 94 of shoelace 90. Unlike prior art devices, the invention may be made of a single piece of material, such as of plastic, such as by molding.

Having described the preferred embodiments of the present invention, many alterations and modifications which are within the inventive concepts disclosed herein will likely occur to those skilled in the art. For example, although a single, continuous shoelace 90 with two free ends 97 is shown and described, it is seen that clasp 10 is operable with two laces 90, each having a free end 97 and an opposite end attached to shoe upper 71. And although a single lace 90 is shown lacing around eyelets 82 and hooks 84, the lace or laces 90 may be firmly anchored to shoe 70A and need not go around an anchor 81. Thus, two laces 90, each with an attached end anchored to a shoe 70A, could have their end sections 94 in clasp 10. Also, the term "shoe", as used in the claims is intended to cover any type of footwear including boots and sandals.

Therefore, it is to be understood that all matter herein is to be interpreted as illustrative and not in any limiting sense, and it is intended to cover in the appended claims such modifications as come within the true spirit and scope of the invention.

I claim:

1. A shoelace clasp for clasping a first end section and a second end section of a shoelace; the first end section being adjacent a first free end; the second end section being adjacent a second free end; said clasp configurable between an open position for receiving the end sections and a closed position clasping the end sections; said clasp in the closed position having a top side, a bottom side, a front side, a rear side, a left side and a right side; said clasp including:

means for connecting said clasp to a shoe;

a base having a top side, a bottom side, a front side, a rear side, a left side and a right side; said base including:

walls defining a left side to right side, upward-opening, first channel and a left side to right side, upward-opening second channel; said first channel having an upward facing surface and left and right ends and with longitudinal axis therebetween; said second channel having an upward facing surface and left and right ends and with longitudinal axis therebetween; said first channel receiving the first end section such that the shoelace protrudes from both said ends of said first channel; the protruding portion having the free end being the first loose section; said second channel receiving the second end section such that the shoelace protrudes from both said ends of said second channel; the protruding portion having the free end being the second loose section;

a cover having a top side, a bottom side, a front side, a rear side, a left side and a right side; said cover hingedly connected to said base; said cover including a downward facing first surface and a downward facing second surface; said cover selectively movable from an open position, wherein the first end section and the second end section may be placed in said channels or removed from said channels, to a closed position, wherein said first surface of said cover overlies said surface of said first channel and retains the first end section therein and said second surface of said cover overlies said surface of said second channel and retains the second end section therein;

said first surface of said cover and said surface of said first channel jointly including a plurality of first ratchet teeth that, in the closed position, are adapted to engage the first end section in said first channel such that the first end section may be moved longitudinally to the right in said first channel by pulling the first loose section so as to tighten the lace but may not be moved to the left;

said second surface of said cover and said surface of said second channel jointly including a plurality of second ratchet teeth that, in the closed position, are adapted to engage the second end section in said second channel such that the second end section may be moved longitudinally to the left in said second channel by pulling the second loose section so as to tighten the lace but may not be moved to the right; and hinge means hingedly connecting said cover to said base.

2. The shoelace clasp of claim 1 wherein:

each first ratchet tooth has a left-facing, gently-sloped face and a right-facing, steeply-sloped face; and each second ratchet tooth has a right-facing, gently-sloped face and a left-facing, steeply-sloped face.

3. The shoelace clasp of claim 2 wherein:

said gently sloping faces have an angle of 45° or less and said steeply sloped faces have an angle of 75° or more.

4. The shoelace clasp of claim 1 wherein:

said hinge means comprises a flexible band that forms an arc in the closed position such that a tunnel is created between said hinge and said base and said cover; said tunnel for receiving said loose sections for storage.

5. The shoelace clasp of claim 1 wherein:

said attachment means includes a flange attached to said base.

6. The shoelace clasp of claim 1 further including:

retaining means for selectively retaining said clasp in the closed position.

* * * * *